United States Patent [19]

Abdrakhmanov et al.

[11] Patent Number: 4,976,322

[45] Date of Patent: Dec. 11, 1990

[54] METHOD OF CONSTRUCTION OF MULTIPLE-STRING WELLS

[76] Inventors: Gabrashit S. Abdrakhmanov, ulitsa Gogolya, 66, kv. 71; Albert G. Zainullin, ulitsa Saidasheva, 1, kv. 117; Filipp G. Arzamastsev, ulitsa Gafiatullina, 36, kv. 37, all of Bugulma; Rashid A. Uteshev, ulitsa Nagornaya, 23, korpus 2, kv. 31, Moscow; Rustam K. Ibat Ullin, ulitsa Gogolya, 66, kv. 49; Izil G. Jusupov, ulitsa Tukaya, 73a, kv. 18, both of Bugulma; Anatoly V. Perov, Varshavskoe shosse, 143, korpus 1, kv. 89, Moscow; Midkhat R. Mavljutov, ulitsa Bljukhera, 18, kv. 20, Ufa; Rashit K. Sannikov, ulitsa Mayakovskogo, 16, kv. 83, Ufa; Vil F. Galiakbarov, ulitsa Dmitrieva, 19, kv. 16, Ufa; Ilyas A. Urazgildin, ulitsa Gafiatullina, 16, kv.70, Bugulma, all of U.S.S.R.

[21] Appl. No.: 423,418

[22] PCT Filed: Nov. 22, 1988

[86] PCT No.: PCT/SU88/00234

§ 371 Date: Sep. 20, 1989

§ 102(e) Date: Sep. 20, 1989

[87] PCT Pub. No.: WO89/06739

PCT Pub. Date: Jul. 27, 1989

[30] Foreign Application Priority Data

Jan. 21, 1988 [SU] U.S.S.R. ..... 4366623

[51] Int. Cl.[5] ..... E21B 33/13

[52] U.S. Cl. ..... 175/57; 166/207; 166/277; 166/285; 166/380

[58] Field of Search ..... 166/277, 285, 387, 179, 166/187, 207, 242, 380

[56] References Cited

U.S. PATENT DOCUMENTS

| | | | |
|---|---|---|---|
| 2,214,226 | 9/1940 | English | 166/277 |
| 2,447,629 | 8/1948 | Beissinger et al. | 166/207 |
| 3,054,455 | 9/1962 | Keltner | 166/187 X |
| 3,191,677 | 6/1965 | Kinley | 166/277 |
| 3,326,293 | 6/1967 | Skipper | 166/187 X |

FOREIGN PATENT DOCUMENTS

| | | |
|---|---|---|
| 0907220 | 2/1982 | U.S.S.R. . |
| 1008419 | 3/1983 | U.S.S.R. . |
| 1010252 | 4/1983 | U.S.S.R. . |

OTHER PUBLICATIONS

Uren, *Petroleum Production Engineering–Oil Field Development,* Fourth Edition, McGraw-Hill Book Co., Inc., N.Y., 1956, pp. 398–401.

Neftyanoe Khozyaistvo, No. 4, 1982, pp. 26 and 27.

*Primary Examiner*—Stephen J. Novosad

*Attorney, Agent, or Firm*—Lilling and Lilling

[57] ABSTRACT

The method of well construction includes the steps of drilling the rock and consolidating it with a conductor casing, a surface casing string and a flow string, and isolating the troublesome zones of the well with profile pipes being reamed in the course of their setting. The reaming of the profile pipes is effected by building up a pressure drop across them and subsequently expanding them. The drilling of the rock after the casing-in of the well with the conductor casing and the surface casing string is preformed with a bit of one and the same diameter, with the troublesome zones being reamed to a diameter equalling the outer diameter of the reamed profile pipes which are successively set in all the troublesome zones of the well as they are exposed by the drilling.

2 Claims, 2 Drawing Sheets

METHOD OF CONSTRUCTION OF MULTIPLE-STRING WELLS

BACKGROUND OF THE INVENTION

1. Field of the Invention

The present invention relates to well-drilling methods, and more particularly it relates to a method of construction of multiple-string wells in a troublesome rock drilling environment.

The present invention can be implemented to the utmost effect for shutting-off incompatible (as regards drilling conditions) beds, that is, beds with abnormal formation pressures, characterized by intense loss of circulation of the drilling mud and inflow of either a fluid or a gas from the exposed formation, as well as for shutting-off troublesome zones of caving-in or crumbling in a well, wherein the known methods are ineffective.

2. Description of the Related Art

There is known a method of construction, of multiple-string wells, wherein the rock-drilling operation is accompanied by flushing of the bottom hole to wash away the drillings. The formation pressures are counterbalanced by the pressure of the column of the washing fluid, controlled by varying its density. However, in many cases formations differ so broadly by the values of their pressures that the abovementioned balance would not be maintained by controlling the washing fluid density. In such cases, prior to drilling into the successive formation, the exposed formation is shut-off with the casing string which is subsequently cemented to avoid the inter-influence of the exposed formations, whereafter the washing fluid density is adjusted to correspond to the pressure of the successive formation, and the drilling is resumed, but with a bit of a smaller diameter. Consequently, the well in its extent from the head to the producing formation is of a stepped diameter diminishing in the downward direction, its wall being lined with several concentrically arranged casing strings. These strings are commonly called, in correspondence with their function, the conductor casing the surface casing string, the intermediate casing string and the flow string. It can be seen that this known technique involves a large input of time, cement and casings.

The desire to minimize the number of the intermediate casing strings by increasing the depth of drilling with a bit of one and the same diameter more often than not leads to additional troubles and even emergencies, such as caving-in or seizure of the drilling tool.

There is further known a method of construction of multiple-string wells (SU, A, No. 907220), including the steps of rock-drilling and consolidating the rock drilled with casing strings defining a conductor casing, a surface casing string intermediate casing strings and a flow string, according to which the zones of lost circulation of drilling mud, not detected at the project stage of the well construction, are shut off by being lined with profile pipes which are reamed while being set by building up a pressure drop across the pipes, followed by their expansion. This allows to shut off the zone of the loss of the washing fluid and continue the drilling operation, which is subsequently followed by setting the corresponding casing strings.

However, in this case, too, the structure of the well remains a multiple-string one, i.e. the last-described method of the prior art does not eliminate intermediate casing strings used for shutting off other troublesome zones in the drilling process. Therefore, this method also involves an increased input of time and materials into the construction of a well which is likewise of a diameter diminishing stepwise in the downward direction. Furthermore, the drilling of such a well requires frequent changes of drilling tools to correspond to the successively diminishing diameters, which further prolongs the drilling operation and makes it more costly, to say nothing of the industry being obliged to produce an unnecessarily large assortment of drilling tools and the associated equipment. It is an object of the present invention to provide a method of construction of multiple-string wells that would ensure casing-in of a well after the setting of the conductor casing and of the surface casing string with casing strings having the same inner diameter.

SUMMARY OF THE INVENTION

This object is attained in a method of well construction, including the steps of drilling the rock and consolidating it with the use of a conductor casing, a surface casing string shutting off incompatible (as regards drilling conditions) beds, isolating the troublesome zones with profile pipes reamed and expanded in the process of their setting into the troublesome zones that have been expanded beforehand, and setting a flow string. According to the presnt invention, the drilling after the casing-in of the well with the conductor casing and the surface casing string is performed with a bit of the same diameter, the troublesome zones being isolated and beds incompatible with drilling conditions being shut off with profile pipes having identical inner diameter after their expansion, which pipes are successively set in the zones incompatible with drilling conditions exposed by the drilling.

The drilling of the well with a bit of one and the same diameter after the setting of the conductor casing and of the surface casing string provides for maintaining the predetermined well diameter down to the target well depth, and thus for eliminating intermediate casing strings thereby reducing the cost and speeding up the construction of the well.

Furthermore, the disclosed method reduces the probability of emergencies, as the troublesome zones are shut off right after they are exposed.

According to a preferred embodiment of the disclosed method in accordance with the invention, at least one of the profile pipes has an initial outer diameter which is less than the hole diameter in the troublesome zone, with the inner diameter of the pipe being increased in the process of reaming the pipe by its expansion to the value of the inner diameter of other expanded pipes.

This manner of increasing the diameter of a profile pipe enhances its strength in the expansion process by eliminating its oval shape and altering the metal structure, thus enhancing its resistance to the collapsing external pressure exerted by the rock. This provides for employing profile pipes for shutting off formations with an abnormally high formation pressure, thus protecting the pipes themselves and the flow strings against collapsing with less expenses incurred.

It is quite expedient to expand a profile pipe to a diameter exceeding its initial diameter by 3–5% . This provides for the maximum possible gain of the strength of the metal of the pipe, as high as 130% to 260% depending on its grade and thickness. With the diameter of a profile pipe being increased still further, in excess of 5% , its resistance to the external collapsing pressure rises but insignificantly, while involving hazardous reduction of the thickness of the wall of the profile pipe.

BRIEF DESCRIPTION OF THE DRAWINGS

Other objects and advantages of the present invention will be made apparent in the following description of examples of its implementation, with reference being made to the accompanying drawings wherein.

DESCRIPTION OF THE PREFERRED EMBODIMENT

The disclosed method of well construction is performed in the following sequence.

A hole is drilled with a bit of a large diameter and cased-in with a conductor casing. Then the drilling is continued with a bit of a smaller diameter, and another casing string is set, called the surface casing string. Thereafter the well is drilled to the target depth with a bit or bits of one and the same diameter, and prior to the exposure of a troublesome zone, a reamer is set above the bit, operated to expand the hole diameter produced by the bit to the expected diameter of expanded profile pipes. Then a string of profile pipes is run into the troublesome zone on the drill pipes, reamed or radially expanded by the pressure of the fluid pumped into the profile pipes and calibrated by an expander to the inner diameter providing for unobstructed passage of the bit for further drilling. All the successive troublesome zones in the process of the drilling of the well to the target depth are drilled into and cased-in in a similar manner, whereafter the flow string is run into the well, and cemented.

In case the drilling operation exposes a formation with a pressure exceeding the collapsing strength of the profile pipes, other profile pipes are set between them, whose diameter before the profiling is less than the well diameter, the length of the last-mentioned profile pipes being selected to exceed the length of the troublesome zone with the abnormally high formation pressure, and the pipes are reamed or further radially expanded to a diameter exceeding the initial diameter of the pipes before their profiling by 3–5% .

The disclosed method of well construction can be illustrated by the following example.

Figure 1:
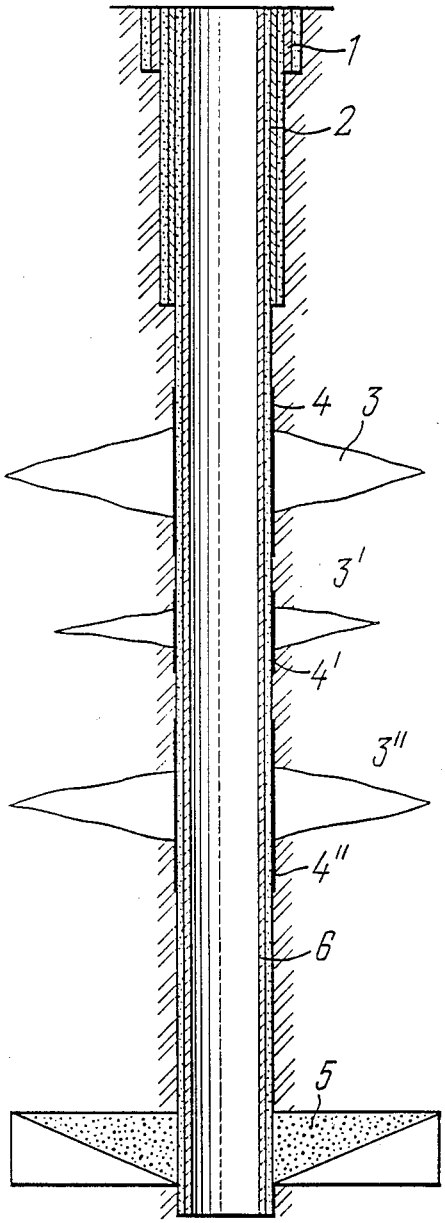
FIG. 1 is a longitudinal sectional view of a well constructed in accordance with the disclosed method.

In accordance with the well program, the drilling for the conductor casing 1 (FIG. 1) was carried out with a bit 394 mm in diameter to a 6 m depth, and the hole was cased-in with standard casings of a 324 mm outer diameter. Then the drilling was continued with a bit 295 mm in diameter to a 300 m depth, with flusning by a drilling mud of a 1.1 g/cm$^3$ density, and cased-in with a surface casing-string 2 of a 245 mm diameter. Afterwards the well was drilled to the target depth of 1800 m with a 215.9 mm diameter bit. In the course of the drilling, the water inflow zone 3 over the 460–470 m interval was isolated with profile pipes 4 set without reducing the well diameter to span the 380–480 m interval, by radially expanding them under the action of the internal fluid pressure of 10–12 MPa and subsequently urging them against the hole wall by expansion, with the hole having been reamed in advance to a 235 mm diameter.

The zones 3' of oil show and water inflow at the 600–640 m depth were isolated in the same manner, with the profile pipes 4' set to span the 534–650 m interval.

The zone 3'' of water inflow at the 820–840 m depth was likewise isolated with profile pipes 4'' spanning the 800–900 m interval.

Then the drilling was resumed with a 215.9 mm diameter bit, using the drilling mud of a density corresponding to the geologic environment of the drilled-in producing formation 5, i.e. of the 1.43 g/cm$^3$ density, and a flow string 6 of 146 mm diameter was set. The well was drilled at the 380–800 m depth with the drilling mud of a 1.29 g/cm$^3$ density, and at the 800–900 m depth, with the mud of a 1.6 g/cm$^3$ density.

Thus, the isolation of the troublesome zones 3, 3', 3'' as they were exposed during the drilling was carried out by setting the strings 4, 4' and 4'' of profile pipes, of the total length of 266 m.

The steel profile pipes 4 are manufactured so as to allow them to have the selective capability of radial deformation or expansion to the desired reamed wellbore diameter by hydraulic pressure introduced by means of the drill string 11 without radially expanding or deforming the drill string 11 itself.

Figure 2:
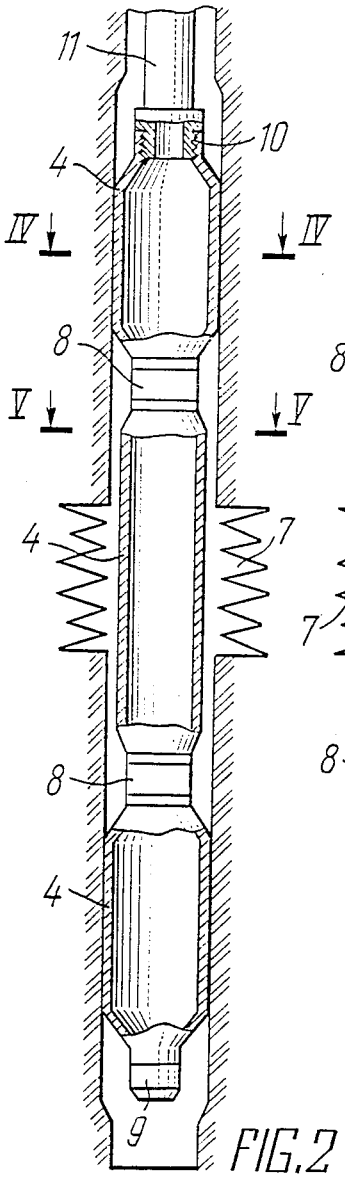
FIG. 2 is a longitudinal sectional view of a portion of the well with a profile pipe set into it, the central pipe of the pipe set after its radial expansion having a diameter smaller than the hole diameter.

When a formation 7 (FIGS. 2 and 3) with an abnormally high formation pressure is exposed, the ends of the central profile pipe 4 in the zone of the formation 7 are provided with packing elements 8 and joined to the lower profile pipe 4 equipped with a shoe 9 and to the upper profile pipe 4 provided with a left-hand connecting thread 10 at its top end.

This set of the profile pipes 4 is run on the drill pipe string 11 to the troublesome zone 7 with the abnormally high formation pressure, so that the central portion of this set between the elements 8 should be set against this zone 7, its circumscribed circle diameter being 3–5% less than the hole diameter in the pre-reamed zone 7, and the diameters of the lower and upper pipes 4 of the set being selected equal to the diameter of the reamed part of the hole in the troublesome zone 7.

Following the running of the set of the profile pipes 4 into the troublesome zone 7, an excess pressure is built up in their internal space by pumping the fluid either by the mud pump or by the cementing unit, this pressure radially expanding and retaining the upper and lower pipes 4 of the set, whereas the central pipe 4 thus radially expanded fails to reach the hole wall by 3–5% of the diameter of its radially expanded portion. Then the pressure is relieved, the drill pipe string 11 is unscrewed from the upper profile pipe 4 and pulled to the surface. This done, an expander 12 (FIG. 3) is run-in on the drill pipe string 11, and the set of the profile pipes 4 is expanded, starting from the upper pipe 4, whereby the upper and lower pipes 4 are calibrated, and the central pipe 4 is further expanded to a diameter exceeding its diameter prior to the profiling by 3–5% .

Figure 3:
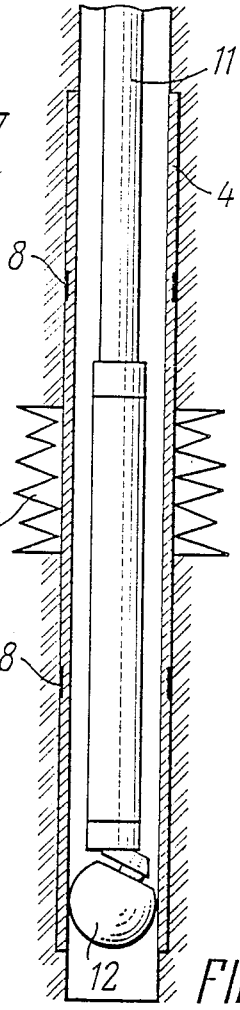
FIG. 3 is a sectional view of a portion of the well with a string of profile pipes set to shut off a troublesome zone.
Figure 4:
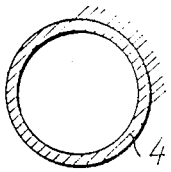
FIG. 4 is a sectional view taken on line IV—IV of FIG. 2.
Figure 5:
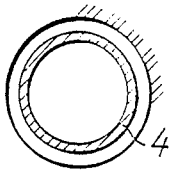
FIG. 5 is a sectional view taken on line V—V of FIG. 2.

Owing to this, the expanded central pipe 4 closely hugs the hole wall, while the packing elements 8 isolate the troublesome zone 7 of the well from the rest of the well, as it can be seen in FIG. 3. At the final stage of calibration of the lower pipe 4 of the set, the shoe 9 is separated therefrom.

As the inner surface of the central profile pipe 4 of the set is expanded, its radial deformation strengthens the metal of this pipe 4, enhancing its hardness. This hardness gain is as high as 130–260% depending on the steel grade and the wall thickness.

The invention can be used for shutting-off formations with abnormally high formation pressures, as well as for shutting-off the zones of caving-in or rock crumbling in a well being constructed, troublesome zones characterized by intense loss of circulation of the drilling mud and inflow of either a fluid or a gas from the exposed formations, wherein the known methods are ineffective.

We claim:

1. A method of well construction, comprising the steps of:

drilling a well in rock;

consolidating said well with a surface casing string and a conductor casing string;

further drilling said well to a specified depth with a bit of one diameter, so that said well has a constant diameter from said conductor casing string to said specified depth;

expanding the diameter of said well at troublesome zones exposed in said well;

isolating said troublesome zones, as they are exposed, with profile pipes having an outer diameter prior to profiling which is less than said expanded diameter of said troublesome zones by setting said profile pipes at said troublesome zones, radially expanding said profile pipes by creating a pressure differential therein, and further expanding said profile pipes so that said outer diameter of said profile pipes equals said expanded diameter of said troublesome zones, and so that an inner diameter of said profile pipes is equal to said constant diameter of said well;

descending and securely fastening a flow string into said well to said specified depth.

2. A method as claimed in claim 1, comprising the additional step of continuing said further expansion of said profile pipe until said inner diameter of said profile pipe is increased by a percentage in the range of 3–5%.

* * * * *